United States Patent [19]

Bushong

[11] 4,245,485

[45] Jan. 20, 1981

[54] FINGER RING GUARD

[76] Inventor: Robert N. Bushong, 506 W. O'Connor, Lima, Ohio 45801

[21] Appl. No.: 44,094

[22] Filed: May 31, 1979

[51] Int. Cl.[3] ..... A44C 9/02

[52] U.S. Cl. ..... 63/15.6

[58] Field of Search ..... 63/15.6

[56] References Cited

U.S. PATENT DOCUMENTS

| | | | |
|---|---|---|---|
| 1,217,097 | 2/1917 | Levin | 63/15.6 |
| 1,341,218 | 5/1920 | Levin | 63/15.6 |
| 1,741,908 | 12/1929 | Becker | 63/15.6 |
| 2,010,444 | 8/1935 | Sokoloff | 63/15.6 |
| 2,817,219 | 12/1957 | Campbell | 63/15.6 |
| 3,218,826 | 4/1965 | De Santo | 63/15.6 |
| 3,238,741 | 3/1966 | Johnson | 63/15.6 |
| 3,360,959 | 1/1968 | Schechter | 63/15.6 |
| 3,380,263 | 4/1968 | Astor | 63/15.6 |
| 3,483,718 | 12/1969 | Lodrini | 63/15.6 |
| 3,552,144 | 1/1971 | Cormier | 63/15.6 |
| 3,901,045 | 8/1975 | Ballester | 63/15.6 |
| 4,043,145 | 8/1977 | Chervin | 63/15.6 |

*Primary Examiner*—F. Barry Shay

*Attorney, Agent, or Firm*—Watts, Hoffmann, Fisher & Heinke Co.

[57] ABSTRACT

A finger ring guard comprising resilient structure extending circumferentially about a central axis of the ring through an angle substantially greater than 180° and ring engaging elements disposed along the outer periphery of the ring and biased radially inwardly toward engagement with the ring periphery by the resilient structure. The resilient structure supports finger engaging surfaces disposed radially inwardly from the ring periphery.

12 Claims, 6 Drawing Figures

FINGER RING GUARD

BACKGROUND OF THE INVENTION

1. Field of the Invention

The present invention relates to finger ring guards.

2. The Prior Art

Loosely fitting finger rings are quite common because in many instances finger knuckles are of greater girth than the portion of the finger on which rings are worn. This is particularly true when the ring wearer suffers from arthritis or other afflictions which cause knuckle enlargement. Moreover, even in cases where finger knuckles are not relatively large, physiological changes result in periodic changes in finger size causing rings to fit loosely from time to time. Various types of ring guards have been proposed by the prior art for enabling finger rings to be worn so that the rings remain properly oriented with respect to the finger without substantial discomfort and risk of loss.

Most of the proposals have been such that the ring guard itself must be installed on the ring before the ring is placed on the wearer's finger. Likewise most ring guards have to be removed from the wearer's finger with the ring. Examples of finger ring guards which are connected to a ring by the use of hand tools, such as pliers, are disclosed by U.S. Pat. Nos. 1,217,097; 1,341,218; 1,741,908; 2,010,444; 2,817,219; 3,238,741; and, 3,552,144. These ring guards are essentially dedicated to one ring because of the difficulty and inconvenience involved in their removal and replacement from one ring to another. If the wearer of rings equipped with these kinds of ring guards has unusually large knuckles and/or is afflicted by arthritis, putting on and taking off the rings can be difficult and painful.

U.S. Pat. No. 3,380,263 discloses a finger ring guard which can be snapped into place after the ring is on the wearer's finger. This type of ring guard is not easily disassembled from the ring at least until the ring has been removed from the finger. Accordingly rings equipped with such guards can be difficult to remove from fingers.

In order to facilitate getting rings on and off fingers without discomfort, ring guards forming a structural part of the ring itself have been proposed. U.S. Pat. Nos. 3,218,826; 3,360,959; and 3,901,045 disclose examples of such devices. These forms of ring guards all involve the use of specially constructed rings or rings which are modified by welding a hinge and catch in place. Although effective in facilitating placement and removal of the rings, these approaches are expensive and therefore not always practical.

U.S. Pat. No. 1,741,908 discloses a ring guard which can be detachably connected to a ring before placing the ring on a finger and can be manipulated so that the ring guard does not interfere significantly when the ring is placed on or removed from the finger. This ring guard proposal employs spring sections which resiliently bear on the inside periphery of the ring and projecting elements which react against the finger adjacent the spring sections. The guard can be swung away from its operative condition without removing it from the ring. Swinging the ring engaging spring sections into and away from their operative positions while the ring is being worn requires a fair degree of manual dexterity and may be difficult for some wearers to accomplish. Moreover the finger engaging elements define relatively small area finger engaging surfaces which can tend to cause discomfort.

SUMMARY OF THE INVENTION

The present invention provides a new and improved ring guard which is detachably connectable to a ring when the ring is being worn, is of simple, relatively inexpensive construction, causes a minimal, if any, discomfort to the wearer and is quite easily assembled to and removed from the ring.

In accordance with a preferred feature of the invention the new ring guard includes resilient structure extending circumferentially about a central axis of an associated ring through an angle substantially greater than 180° and ring engaging elements disposed along the outer ring periphery and biased radially inwardly toward engagement with the outer ring periphery. The resilient structure supports at least a finger engaging surface disposed radially inwardly from the ring periphery.

The ring engaging elements tend to engage the ring periphery and maintain the ring and finger lightly engaged with each other. The biasing force on the ring engaging elements likewise tends to urge the finger engaging surface into contact with the finger and resists accidental dislodgement of the ring guard from the ring and finger.

The new ring guard can be assembled to and removed from the ring and finger. This is accomplished manually by spreading the ring engaging elements apart and sliding them past the maximum diametrical extent of the ring. A high degree of dexterity is not required for assembly and disassembly of the new ring guard.

In a preferred embodiment of the invention the resilient structure is formed by axially spaced apart wire-like spring elements which extend circumferentially about the ring axis and are connected to each ring engaging element. The ring engaging elements extend generally parallel to the ring axis between the spring elements. The preferred spring elements each includes at least a reentrantly curved section extending radially inwardly from the ring periphery for engagement with a finger on which the ring is worn. The reentrantly curved sections provide axially spaced ring abutments which can engage the ring and limit relative movement if the ring and guard should tend to become skewed relative to each other or otherwise axially misaligned.

Additional features and advantages of the invention will become apparent from the following description of a preferred embodiment made in reference to the accompanying drawings which form part of the specification.

DESCRIPTION OF A PREFERRED EMBODIMENT

Figure 1:
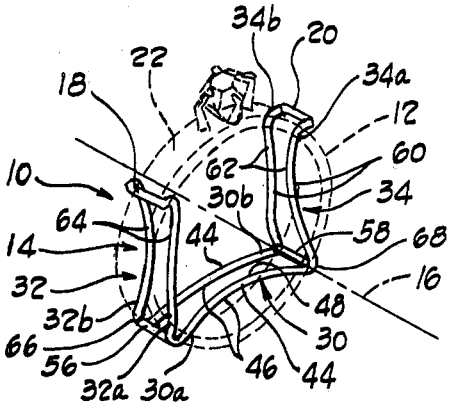
FIG. 1 is a perspective view of a ring guard constructed according to a preferred embodiment of the invention.

A finger ring guard 10 embodying the present invention is illustrated by the drawings. Referring to FIG. 1 of the drawings the finger ring guard 10 is shown assembled to a ring 12, illustrated by broken lines, and comprises a resilient structure 14 extending circumferentially about a central ring axis 16 through an angle substantially greater than 180°, and ring engaging elements 18, 20 disposed along the outer ring periphery 22 which are biased radially inwardly engagement with the ring outer periphery by the resilient structure 14.

The resilient structure 14 includes a base 30 and arms 32, 34 each of which projects from the base 30 to a respective one of the ring engaging elements 18, 20. The arms and base are resiliently flexible and formed so that the projecting arm end portions are biased against movement away from each other. This in turn biases the ring engaging elements 18, 20 towards engagement with the outer ring periphery 22 when the ring guard 10 is assembled to the ring 12.

The base 30 is preferably constructed from generally parallelly extending wire-like spring elements **30*a*, 30*b* which are disposed on respective opposite axial sides of the ring. Each spring element forms a reentrantly curved central section 44 configured to extend radially inwardly from the inner ring periphery between opposite ends of the base 30. Each central section 44 defines a finger-engaging surface 46 facing radially inwardly relative to the ring. Confronting sides 48 of the central sections 44 define axially spaced ring abutments which can engage the axial sides of the ring to prevent relative skewing or axial misalignment of the ring 12 relative to the ring guard 10. In the preferred and illustrated embodiment of the invention the central sections 44 are bowed axially towards each other so that the ring abutments formed by the confronting sides 48** converge gradually proceeding toward the mid point of the central section.

In the preferred embodiment reinforcing struts 56, 58 extend generally parallel to the ring axis 16 between the spring elements **30*a*, 30*b* at the opposite respective ends of the base. The struts 56, 58 rigidify the ring guard 10 and form radial stops engageable with the ring outer periphery 22 to assure that the ring guard 10 remains assembled to the ring 12** in case the ring and guard are assembled when the ring is not being worn.

Each of the arms 32, 34 is formed by generally parallel extending wire-like spring elements **32*a*, 32*b* and 34*a*, 34*b*, respectively. The spring elements forming each arm are spaced from opposite axial sides of the ring and, as illustrated, each arm element defines a reentrantly curved central section 60 extending radially inwardly from the inner ring periphery. Each central arm section 64 defines a finger-engaging surface 62 facing radially inwardly relative to the ring. Confronting axially spaced arm element sides 64 form axial ring abutments for abutting the ring and preventing relative skewing or other axial misalignment in cooperation with the abutments formed by the base spring element sides 48. In the illustrated embodiment of the invention the spring elements are bowed axially towards each other so that the ring abutments formed by the arm element sides 64 converge proceeding toward the middle of each central section 60**. To the extent of this bowed configuration the spring elements are not completely parallel. The axially bowed spring elements lend stability to the assembly of the ring and ring guard because they tend to resiliently grip the axial faces of the ring as the ring guard is placed on and removed from the ring as well as when the ring guard is expanded by a finger which is nearly the same size as the ring.

In the preferred ring guard 10 the arms 32, 34 are continuous with the base 30 and merge with the base at rounded corner-like junctures 66, 68. The struts 56, 58 extend between the base spring elements **30*a*, 30*b* adjustment the junctures 66, 68 so that the corner-like configuration of the junctures is established during resilient flexure of the arms relative to the base. The rounded configuration of the junctures 66, 68** prevents undue stress concentrations when flexure occurs.

The projecting ends of the arms 32, 34 are attached to the ring engaging elements 18, 20. In the preferred embodiment of the invention the ring engaging elements are continuous with and extend axially between the arm spring elements. The arm spring elements are bent and outwardly flared immediately adjacent their merger with the ring engaging elements. The ring engaging elements themselves are preferably formed by thin narrow, straight lengths of the ring guard material substantially like the struts 56, 58.

Figure 2:
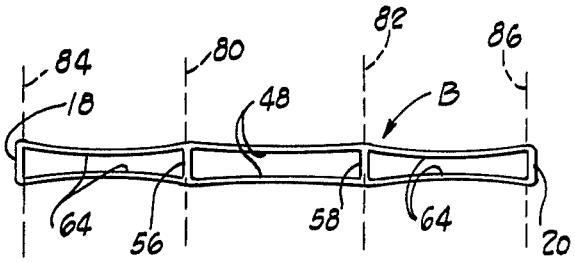
FIG. 2 is an elevational view of a blank article from which the ring guard of FIG. 1 may be formed.

FIG. 2 illustrates a blank article B from which a ring guard 10 embodying the invention can be fabricated. As illustrated by FIG. 2 the blank B is formed by stamping it from a thin sheet of metal suitable for use as a light spring. The stamping operation enables the base and arm spring elements to be formed continuously with each other and continuously with the ring engaging elements 18, 20 and struts 56, 58. Broken lines 80, 82 illustrate locations at which the corner-like junctures 66, 68 are formed while the broken lines 84, 86 illustrate the location of crease lines where the arms 32, 34 merge with the ring engaging elements 18, 20, respectively. After the blank B is bent appropriately along the locations of the broken lines 80, 82, 84, 86, the more gently curved arm and base central sections are formed in the material resulting in the ring guard assuming its completed configuration. The formed blank is next tempered to provide a desired spring characteristic and polished, plated or otherwise treated to complete its fabrication.

A ring guard which is fashioned from a stamping as illustrated by FIG. 2 provides wire-like arm and base spring elements having generally square or, flat rectangular cross-sectional shapes which aid in the ring guard base and arms functioning as a flexible gently resilient flat or leaf spring.

It should be appreciated, however, that the ring guard 10 can be fashioned in other ways. For example, the ring guard can be formed from circular cross section metal wire having its struts and the ring engaging elements welded or brazed in place. The ring guard may also be formed by injection molding a resilient plastic material.

Where a ring is worn by an individual who does not suffer from painful and/or swollen finger knuckles a ring guard embodying the present invention can be assembled to a ring prior to its being placed on a finger and can be left assembled to the ring as it is removed from the finger without causing inconvenience or any significant discomfort. As the finger moves axially through the ring and ring guard the arm and base central sections are engaged by the finger and tend to resiliently shift radially outwardly relative to the ring. The guard flexure allows finger knuckles to pass through it without exerting substantial pressure forces on the finger. The resilient force which is exerted on the finger is distributed along the finger engaging surfaces 46, 62 of the base and arms.

When the ring 12 and guard 10 are being worn on a finger (See FIG. 5) the ring engaging elements 18, 20 are resiliently spaced apart somewhat to accommodate the finger. The arms 32, 34 are spring biased towards engagment with the sides of the finger and the ring engaging elements 18, 20 engage the ring at locations closer to the maximum ring diameter than they do when the guard is assembled to a ring which is not being worn.

Figure 3:
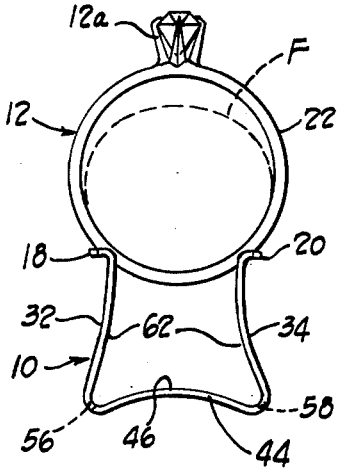
FIG. 3 is a elevational view of a ring guard and ring at an initial stage of assembly of the ring guard to the ring.
Figure 4:
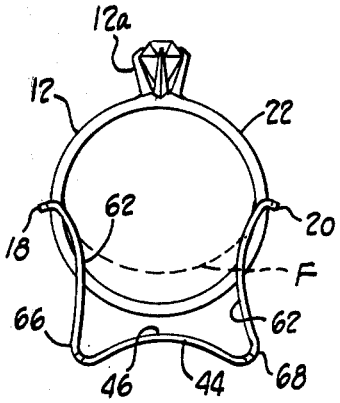
FIG. 4 is an elevational view similar to FIG. 3 showing the ring guard partially assembled to the ring.
Figure 5:
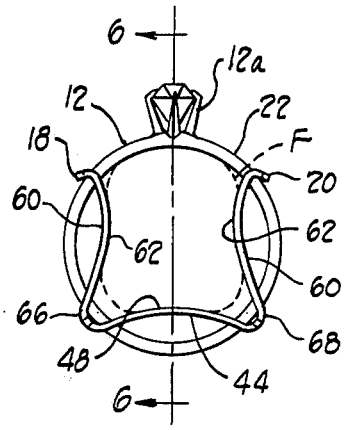
FIG. 5 is an elevational view similar to FIGS. 3 and 4 showing the ring and ring guard assembled; and, FIG. 6 is a cross-sectional view seen approximately from the plane indicated by the line 6—6 of FIG. 5 on a scale which is enlarged from the scale of FIG. 5.

An important feature of the present invention is that a ring guard constructed according to the invention can be assembled to and removed from a ring which is already positioned on a finger. Assembly of the ring guard in these circumstances is illustrated by FIGS. 3–5 and is particularly convenient for ring wearers who suffer from painful or enlarged finger knuckles. As shown by FIG. 3, the ring 12 is situated at a desired position on a finger F (shown in broken lines). The ring guard 10 is positioned for assembly to the ring with the ring engaging elements engaging the outer ring periphery 22 opposite from the ring setting (12*a*). The ring guard is then pushed toward the setting 12*a* resulting in the ring engaging elements 18, 20 being cammed outwardly by the ring periphery against the biasing force provided by the arms 32, 34 which are resiliently spread apart by the camming action (See FIG. 4). The outwardly flared ends of the ring guard adjacent the ring engaging elements effectively guide the ring guard along the ring periphery during this stage of the assembly.

As the ring engaging elements 18, 20 pass the maximum diametrical extent of the ring they continue to resiliently engage and follow the outer ring periphery by virtue of the biasing force provided by the arms 32, 34. The central arm sections concomitantly move radially inwardly of the ring periphery and engage the finger F tending to displace the flesh towards the ring guard base 30. The axially bowed arm spring elements may engage the axial sides of the ring during assembly and, when this occurs, the confronting abutment faces 64 resiliently flex as the ring passes between them. The ring engaging elements 18, 20 continue to follow along the ring periphery 22 until the ring guard 10 is fairly snugly engaged about the finger F and with the resilient forces applied to the finger effectively distributed over a relatively sizable area.

Figure 6:
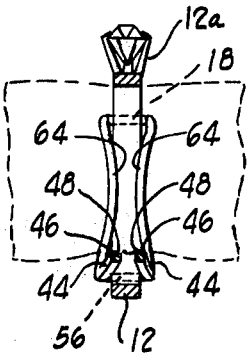

FIG. 6 shows the engagement of the base spring elements 30*a*, 30*b* with the finger F and, as illustrated, the elements 30*a*, 30*b* have a square cross sectional shape with the finger engaging surface 46 formed by one face. The elements 30*a*, 30*b* are relatively close together along the area of finger engagement which has the effect of minimizing the pressure of engagement between the ring guard and finger.

FIG. 5 illustrates the ring guard 10 assembled to a ring and finger. In a situation where the finger is relatively larger than the finger F illustrated in FIG. 5 the struts 56, 58 may be spaced a short distance radially away from the outer ring periphery 22; but the corner-like junctures 66, 68 do not project away from the ring far enough to be noticed by the wearer. Because the arm spring elements are bowed axially toward each other by a slight amount the abutment faces 64 tend to move closer to the axial sides of the ring and thus tend to improve stability of the ring and ring guard assembly. The ring engaging elements 18, 20 are thin and relatively narrow so that they are not readily noticable when the ring and ring guard are being worn.

The ring guard 10 is removable from the ring 12 and finger F simply by sliding it from the ring with enough force to cam the ring engaging elements over and past the maximum diametrical extent of the ring. The amount of force required to remove the ring guard is sufficient that loss of the ring guard by its accidental dislodgement is quite unlikely yet no great hand strength or dexterity is required.

While a single embodiment of the invention has been illustrated and described in considerable detail the present invention is not to be considered limited to the precise construction shown. Various adaptations, modifications and uses of the invention may occur to those skilled in the art to which the invention relates and the invention is to cover all such adaptations, modifications, and uses which come within the scope or spirit of the attached claims.

What is claimed is:

1. A finger ring guard comprising resilient structure defining spaced apart end portions, said structure extending circumferentially about a central axis of the ring through an angle substantially greater than 180° and ring engaging elements disposed respectively at said end portions along the outer periphery of the ring and biased radially inwardly toward engagement with the ring outer periphery by said resilient structure, said ring engaging elements slidably engageable with the ring outer periphery so that said ring guard is slidable into position on the ring in a direction substantially perpendicular to the central axis, said resilient structure supporting at least a finger engaging surface disposed radially inwardly from the ring periphery.

2. The ring guard claimed in claim 1 wherein said resilient structure comprises axially spaced apart spring elements each defining a ring abutment for preventing relative skewing between the ring guard and ring.

3. The ring guard claimed in claim 2 wherein each of said spring elements defines a reentrantly curved section extending radially inwardly from the ring periphery, each spring element defining a finger engaging surface.

4. The ring guard claimed in claim 1 wherein said resilient structure is formed by a base and arms extending from said base, each arm extending to a respective one of said ring engaging elements.

5. The ring guard claimed in claim 4 wherein said base and arms are each formed by axially spaced apart spring elements.

6. The ring guard claimed in claim 5 wherein said spring elements forming said arms define reentrantly curved sections extending radially inwardly from the ring periphery, said reentrantly curved sections defining finger engaging surfaces.

7. The ring guard claimed in claim 6 wherein said spring elements are axially bowed toward each other proceeding toward the center of the reentrantly curved sections, said axially bowed portions forming confronting axial ring abutments.

8. The ring guard claimed in claim 6 wherein each of said ring engaging extends generally parallel to the ring axis between the spring elements of the associated arm.

9. The ring guard claimed in claim 1 wherein said finger engaging surface is spaced circumferentially relative to said ring from said ring engaging elements.

10. The ring guard claimed in claim 9 wherein said finger engaging surface is resiliently supported for engagement with a finger by said resilient structure.

11. A finger ring guard comprising resilient structure extending circumferentially about a central axis of the ring through an angle substantially greater than 180° and ring engaging elements disposed along the outer periphery of the ring and biased radially inwardly toward engagement with the ring periphery by said resilient structure, said resilient structure supporting at least a finger engaging surface disposed radially inwardly from the ring periphery and formed by a base and arms extending from said base, each arm extending to a respective one of said ring engaging elements, said base and arms merging at corner-like junctures remote from said ring engaging elements and each formed by axially spaced apart spring elements.

12. The ring guard claimed in claim 11 further including reinforcing struts extending between said spring elements in the vicinity of said corner-like junctures, said reinforcing struts disposed radially outwardly from the ring periphery.

* * * * *